US006702019B2

(12) United States Patent
Dusterhoft et al.

(10) Patent No.: US 6,702,019 B2
(45) Date of Patent: Mar. 9, 2004

(54) APPARATUS AND METHOD FOR PROGRESSIVELY TREATING AN INTERVAL OF A WELLBORE

(75) Inventors: Ronald G. Dusterhoft, Katy, TX (US); Syed Hamid, Dallas, TX (US); Roger L. Schultz, Aubrey, TX (US); Robert Ken Michael, Plano, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/012,916

(22) Filed: Oct. 22, 2001

(65) Prior Publication Data

US 2003/0075325 A1 Apr. 24, 2003

(51) Int. Cl.[7] ..... E21B 43/04
(52) U.S. Cl. ..... 166/278; 166/242.3; 166/51
(58) Field of Search ..... 166/242.3, 373, 166/376, 278, 51, 317, 386, 236, 157

(56) References Cited

U.S. PATENT DOCUMENTS

| | | | | |
|---|---|---|---|---|
| 1,975,162 A | * | 10/1934 | Layne | 166/278 |
| 2,342,913 A | | 2/1944 | Williams et al. | |
| 2,344,909 A | | 3/1944 | Williams et al. | |
| 4,102,395 A | | 7/1978 | Robinson | |
| 4,553,595 A | * | 11/1985 | Huang et al. | 166/278 |
| 4,558,742 A | * | 12/1985 | Huang et al. | 166/278 |
| 4,646,839 A | * | 3/1987 | Rickey | 166/335 |
| 4,945,991 A | | 8/1990 | Jones | 166/278 |
| 5,082,052 A | | 1/1992 | Jones et al. | 166/51 |
| 5,113,935 A | | 5/1992 | Jones et al. | 166/51 |
| 5,161,613 A | | 11/1992 | Jones | 166/242 |
| 5,161,618 A | | 11/1992 | Jones et al. | 166/308 |
| 5,332,039 A | * | 7/1994 | Primeaux et al. | 166/278 |
| 5,333,688 A | | 8/1994 | Jones et al. | 166/278 |
| 5,355,956 A | | 10/1994 | Restarick | 166/296 |
| 5,390,966 A | | 2/1995 | Cox et al. | 285/137.1 |
| 5,419,394 A | | 5/1995 | Jones | 166/51 |
| 5,443,117 A | | 8/1995 | Ross | 166/51 |
| 5,476,143 A | | 12/1995 | Sparlin et al. | 166/233 |
| 5,515,915 A | | 5/1996 | Jones et al. | 166/51 |

(List continued on next page.)

FOREIGN PATENT DOCUMENTS

| | | | |
|---|---|---|---|
| EP | 1 132 571 | 9/2001 | E21B/43/267 |
| WO | WO 99/12630 | 3/1999 | B01D/29/15 |
| WO | WO 00/61913 | 10/2000 | E21B/43/04 |
| WO | WO 01/14691 | 3/2001 | E21B/43/08 |
| WO | WO 01/44619 | 6/2001 | E21B/43/04 |
| WO | WO 02/10554 | 2/2002 | E21B/43/26 |

OTHER PUBLICATIONS

"Mechanical Fluid–Loss Control Systems Used During Sand Control Operations," H.L. Restarick of Otis Engineering Corp., 1992.

(List continued on next page.)

*Primary Examiner*—David Bagnell
*Assistant Examiner*—Daniel P Stephenson
(74) *Attorney, Agent, or Firm*—Lawrence Youst

(57) ABSTRACT

An apparatus and method for progressively treating an interval of a wellbore (32) is disclosed. The apparatus comprises a sand control screen (138) that is eccentrically positioned within the wellbore (32) and a fluid delivery tubular (140) that is disposed within the wellbore (32) adjacent to the sand control screen (138). During a treatment process when a treatment fluid is pumped into the fluid delivery tubular (140), the fluid delivery tubular (140) progressively allows the treatment fluid to exit from the interior of the fluid delivery tubular (140) to the exterior of the fluid delivery tubular (140) from a first end (46) of the interval (48) to a second end (44) of the interval (48) to progressively treat the interval (48) of the wellbore (32).

55 Claims, 9 Drawing Sheets

U.S. PATENT DOCUMENTS

| | | | | | |
|---|---|---|---|---|---|
| 5,588,487 | A | | 12/1996 | Bryant | 166/51 |
| 5,636,691 | A | | 6/1997 | Hendrickson et al. | 166/278 |
| 5,755,286 | A | | 5/1998 | Ebinger | 166/281 |
| 5,842,516 | A | | 12/1998 | Jones | 166/56 |
| 5,848,645 | A | | 12/1998 | Jones | 166/280 |
| 5,868,200 | A | | 2/1999 | Bryant et al. | 166/51 |
| 5,890,533 | A | | 4/1999 | Jones | 166/51 |
| 5,921,318 | A | | 7/1999 | Ross | 166/250.17 |
| 5,934,376 | A | | 8/1999 | Nguyen et al. | 166/278 |
| 6,003,600 | A | | 12/1999 | Nguyen et al. | 166/281 |
| 6,047,773 | A | | 4/2000 | Zeltmann et al. | 166/281 |
| 6,059,032 | A | | 5/2000 | Jones | 166/278 |
| 6,116,343 | A | | 9/2000 | Van Petegem et al. | 166/297 |
| 6,125,933 | A | | 10/2000 | Ross | 166/250.01 |
| 6,220,345 | B1 | | 4/2001 | Jones et al. | 166/51 |
| 6,227,303 | B1 | | 5/2001 | Jones | 166/378 |
| 6,230,803 | B1 | | 5/2001 | Morton et al. | 166/278 |
| 6,343,651 | B1 | | 2/2002 | Bixenman | 166/278 |
| 6,397,950 | B1 | * | 6/2002 | Streich et al. | 166/376 |
| 6,446,729 | B1 | * | 9/2002 | Bixenman et al. | 166/386 |
| 6,450,263 | B1 | * | 9/2002 | Schwendemann | 166/373 |
| 6,464,007 | B1 | * | 10/2002 | Jones | 166/279 |
| 6,494,261 | B1 | * | 12/2002 | Pahmiyer | 166/281 |
| 6,588,507 | B2 | | 7/2003 | Dusterhoft et al. | |

OTHER PUBLICATIONS

"Sand Control Screens," Halliburton Energy Services, 1994.

"Frac Pack Technology Still Evolving," Charles D. Ebinger of Ely & Associates Inc.; Oil & Gas Journal, Oct. 23, 1995.

"Screenless Single Trip Multizone Sand Control Tool System Saves Rig Time," Travis Hailey and Morris Cox of Haliburton Energy Services, Inc.; and Kirk Johnson of BP Exploration (Alaska), Inc. Society of Petroleum Engineers Inc., Feb., 2000.

"Caps$^{SM}$ Sand Control Service for Horizontal Completions Improves Gravel Pack Reliability and Increases Production Potential from Horizontal Completions," Halliburton Energy Services, Inc., Aug., 2000.

"CAPS$^{SM}$ Concentric Annular Packing Service for Sand Control," Halliburton Energy Services, Inc., Aug., 2000.

"Simultaneous Gravel Packing and Filter Cake Removal in Horizontal Wells Applying Shunt Tubes and Novel Carrier and Breaker Fluid," Pedro M. Saldungaray of Schlumberger; Juan C. Troncoso of Repson–YPF; Bambang T. Santoso of Repsol–YPF. Society of Petroleum Engineers, Inc., Mar., 2001.

* cited by examiner

APPARATUS AND METHOD FOR PROGRESSIVELY TREATING AN INTERVAL OF A WELLBORE

TECHNICAL FIELD OF THE INVENTION

This invention relates in general to the treatment of a production interval of a wellbore to stimulate hydrocarbon production and prevent the production of fine particulate materials and, in particular, to an apparatus and method for progressively gravel packing or progressively frac packing the production interval of the wellbore.

BACKGROUND OF THE INVENTION

It is well known in the subterranean well drilling and completion art that relatively fine particulate materials may be produced during the production of hydrocarbons from a well that traverses an unconsolidated or loosely consolidated formation. Numerous problems may occur as a result of the production of such particulate. For example, the particulate cause abrasive wear to components within the well, such as tubing, pumps and valves. In addition, the particulate may partially or fully clog the well creating the need for an expensive workover. Also, if the particulate matter is produced to the surface, it must be removed from the hydrocarbon fluids using surface processing equipment.

One method for preventing the production of such particulate material is to gravel pack the well adjacent the unconsolidated or loosely consolidated production interval. In a typical gravel pack completion, a sand control screen is lowered into the wellbore on a work string to a position proximate the desired production interval. A fluid slurry including a liquid carrier and a relatively coarse particulate material, such as sand, gravel or proppants which are typically sized and graded and which are typically referred to herein as gravel, is then pumped down the work string and into the well annulus formed between the sand control screen and the perforated well casing or open hole production zone.

The liquid carrier either flows into the formation or returns to the surface by flowing through a wash pipe or both. In either case, the gravel is deposited around the sand control screen to form the gravel pack, which is highly permeable to the flow of hydrocarbon fluids but blocks the flow of the fine particulate materials carried in the hydrocarbon fluids. As such, gravel packs can successfully prevent the problems associated with the production of these particulate materials from the formation.

It is sometimes desirable to perform a formation fracturing and propping operation prior to or simultaneously with the gravel packing operation. Hydraulic fracturing of a hydrocarbon formation is sometimes necessary to increase the permeability of the production interval adjacent the wellbore. According to conventional practice, a fracture fluid such as water, oil, oil/water emulsion, gelled water or gelled oil is pumped down the work string with sufficient volume and pressure to open multiple fractures in the production interval. The fracture fluid may carry a suitable propping agent, such as sand, gravel or proppants, which are typically referred to herein as proppants, into the fractures for the purpose of holding the fractures open following the fracturing operation.

The fracture fluid must be forced into the formation at a flow rate great enough to fracture the formation allowing the entrained proppant to enter the fractures and prop the formation structures apart, producing channels which will create highly conductive paths reaching out into the production interval, and thereby increasing the reservoir permeability in the fracture region. As such, the success of the fracture operation is dependent upon the ability to inject large volumes of hydraulic fracture fluid along the entire length of the formation at a high pressure and at a high flow rate.

It has been found that it is difficult to achieve a complete gravel pack of the desired production interval either independent of or as part of a fracturing operation, particularly in long or inclined/horizontal production intervals. These incomplete packs are commonly a result of the liquid carrier entering the permeable portions of the production interval causing the gravel to form a sand bridge in the annulus. Thereafter, the sand bridge prevents the gravel pack slurry from flowing to the remainder of the annulus which, in turn, prevents the placement of sufficient gravel in the remainder of the annulus.

Therefore a need has arisen for an apparatus and method that are capable of creating fractures along the entire length of a production interval. A need has also arisen for such an apparatus and method that can produce a complete gravel pack of the wellbore adjacent to the production interval either independent of or as part of the fracturing of the production interval. Further, a need has arisen for an apparatus and method that are capable of stimulating the production interval to enhance production and gravel packing the production interval to prevent the production of fine particulate materials when production commences.

SUMMARY OF THE INVENTION

The present invention disclosed herein comprises an apparatus and method that is capable of enhancing production from a production interval by creating fractures throughout the entire interval and producing a substantially complete gravel pack of the wellbore adjacent to the production interval to prevent the production of fine particulate materials when production commences. The apparatus and method of the present invention achieves these results by progressively treating the production interval from one end to the other.

The apparatus comprises a sand control screen that is positioned within the wellbore and a fluid delivery tubular positioned adjacent to sand control screen in the wellbore. The fluid delivery tubular progressively allows fluid communication from the interior of the fluid delivery tubular to the exterior of fluid delivery tubular from a first end to a second end of the interval, thereby delivering the treatment fluid along the entire length of the interval.

The fluid delivery tubular may comprises a plurality of actuatable members. The actuatable devices may be rupture disks, pressure actuated one-way valves or other pressure actuated devices that are positioned along a portion of the length of the fluid delivery tubular such that the pressure required to actuate the actuatable members progressively increases from the first end to the second end of the interval. Alternatively, the actuatable device may be progressively actuated from the first end to the second end of the interval using signals sent from the surface using hard wire connections, fiber optics, hydraulics or wireless telemetry.

The fluid delivery tubular may alternatively comprise a perforated pipe having a plurality of removable members positioned on the interior or the exterior thereof. The removable members may be propellants or other combustible material members each having an initiator. The initiators may be activated using signals. Alternatively, the initiators may have pressure activated firing devices that are positioned such that the pressure required to fire the pressure activated firing devices progressively increasing from the first end to the second end of the interval.

The removable members may alternatively be friable members that are progressively removable from the first end to the second end of the interval. Each friable member may include a pressure actuated vibration generator. In this case, the pressure actuated vibration generators are positioned such that the pressure required to activate the pressure actuated vibration generators progressively increasing from the first end to the second end of the interval. Alternatively, each of the friable members may have a vibration generator that activated by a signal sent from the surface.

The method of the present invention comprises traversing the formation with the wellbore, locating a sand control screen eccentrically within the wellbore proximate the formation, positioning a fluid delivery tubular adjacent to the sand control screen within the wellbore, injecting a treatment fluid into the fluid delivery tubular, progressively establishing fluid communication between the interior of the fluid delivery tubular and the exterior of the fluid delivery tubular from the first end to the second end of the interval and terminating the injecting when the interval is treated.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
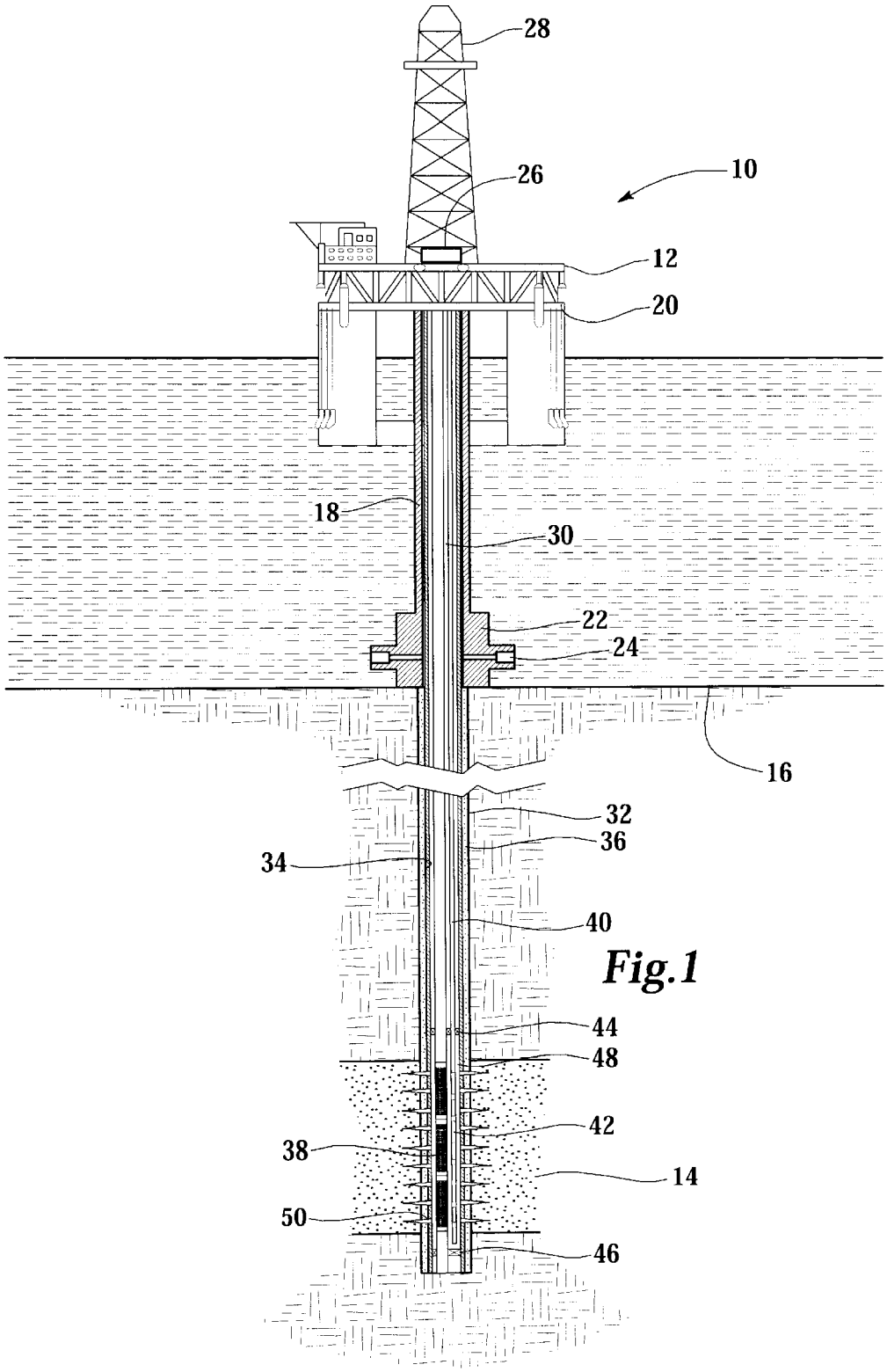
FIG. 1 is a schematic illustration of an offshore oil and gas platform operating an apparatus for progressively treating an interval of a wellbore of the present invention.

Referring initially to FIG. 1, an apparatus for progressively treating an interval of a wellbore operating from an offshore oil and gas platform is schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering pipe strings such as work string 30.

A wellbore 32 extends through the various earth strata including formation 14. A casing 34 is cemented within wellbore 32 by cement 36. Work string 30 includes various tools including a sand control screen assembly 38 which is positioned within wellbore 32 adjacent to formation 14. Also extending from platform 12 through wellbore 32 is a fluid delivery tubular 40 having a fluid discharge section 42 positioned adjacent to formation 14 which is used to frac pack or gravel pack the production interval 48 between packers 44, 46. When it is desired to treat interval 48, work string 30 and fluid delivery tubular 40 are lowered through casing 34 until sand control screen assembly 38 and fluid discharge section 42 are positioned adjacent to formation 14 including perforations 50. Thereafter, a treatment fluid containing sand, gravel, proppants or the like is pumped down delivery tubular 40 to progressively treat interval 48.

Even though FIG. 1 depicts a vertical well, it should be noted by one skilled in the art that the apparatus for progressively treating an interval of a wellbore of the present invention is equally well-suited for use in deviated wells, inclined wells or horizontal wells. Also, even though FIG. 1 depicts an offshore operation, it should be noted by one skilled in the art that the apparatus for progressively treating an interval of a wellbore of the present invention is equally well-suited for use in onshore operations.

Figure 2:
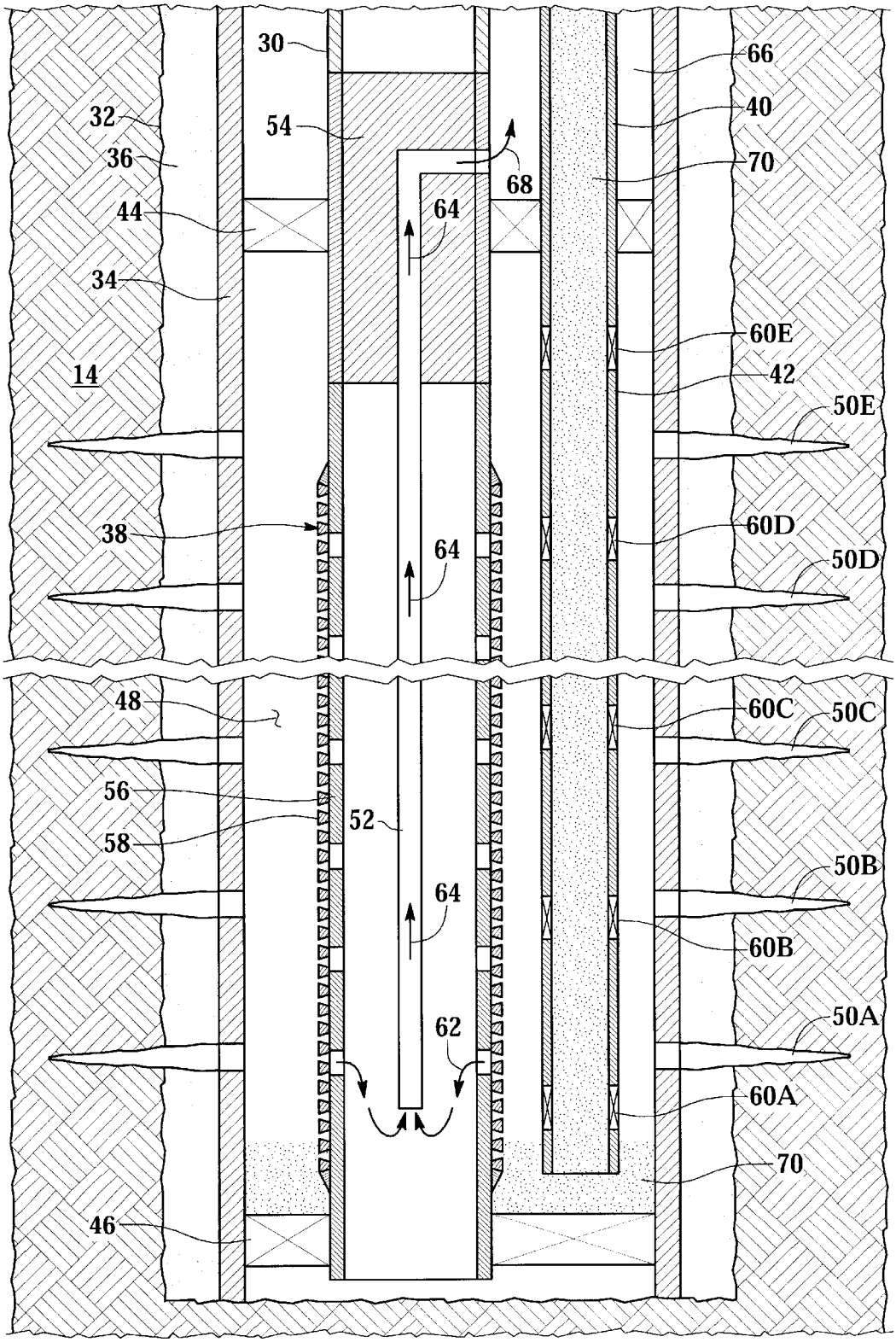
FIG. 2 is a half sectional view of an apparatus for progressively treating an interval of a wellbore of the present invention in its initial position.

Referring now to FIG. 2, therein is depicted a more detailed illustration of interval 48. As illustrated, screen assembly 38 is eccentrically positioned within casing 34 and is adjacent to formation 14. A wash pipe 52 is positioned within screen assembly 38. Wash pipe 52 extends into a cross-over assembly 54 which is connected to work string 30 extending from the surface. Screen assembly 38 is designed to allow fluid to flow therethrough but prevent particulate matter of sufficient size from flowing therethrough. The exact design of screen assembly 38 is not critical to the present invention as long as it is suitably designed for the characteristics of the formation fluids and the treatment fluids. For example, as illustrated, screen assembly 38 includes a perforated base pipe 56 having a wire 58 wrapped directly thereon. Alternatively, a plurality of ribs may be placed around the base pipe to provide stand off between the base pipe and the wire wrap. It should be noted by those skilled in the art that even though FIG. 2 has depicted a wire wrapped screen, other types of filter media could alternatively be used without departing from the principles of the present invention. For example, a fluid-porous, particulate restricting, sintered metal material such as a plurality of layers of a wire mesh that are sintered together to form a porous sintered wire mesh screen could alternatively be used.

In the illustrated embodiment, fluid discharge section 42 of fluid delivery tubular 40 includes a plurality of progressively actuatable members 60A–60E. Suitable actuatable members 60A–60E include rupture disks or valves and are preferably one-way valves that selectively allow fluid to flow from the interior of fluid delivery tubular 40 to the exterior of fluid delivery tubular 40. Actuatable members 60A–60E may be progressively actuated using a variety of known techniques such as sending a signal via a direct electrical connection, fiber optics, hydraulics, wireless telemetry including pressure pulses, electromagnetic waves or acoustic signals and the like. Actuatable members 60A–60E are preferably pressure actuated one-way valves as explained in more detail below.

To begin the completion process, interval 48 adjacent to formation 14 is isolated. Packer 44 seals the near end of interval 48 and packer 46 seals the far end of interval 48. Cross-over assembly 54 is located adjacent to screen assembly 38, traversing packer 44 with portions of cross-over assembly 54 on either side of packer 44. As illustrated, when the treatment operation is a gravel pack, the objective is to uniformly and completely fill interval 48 with gravel. To help achieve this result, wash pipe 52 is disposed within screen assembly 38. Wash pipe 52 extends into cross-over assembly 54 such that return fluid passing through screen assembly 38, indicated by arrows 62, may travel through wash pipe 52, as indicated by arrow 64, and into annulus 66, as indicted by arrow 68, for return to the surface.

The fluid slurry containing gravel 70 is pumped down fluid delivery tubular 40. In the illustrated embodiment, the fluid slurry containing gravel 70 travels to the far end of interval 48 through fluid delivery tubular 40. As illustrated, a portion of fluid slurry containing gravel 70 exits the open end of fluid delivery tubular 40. As gravel 70 builds up at the far end of interval 48, the pressure within fluid delivery tubular 40 will begin to increase. Alternatively, the far end of fluid delivery tubular 40 could be closed in which case the pressure also increases in fluid delivery tubular 40 when the fluid slurry containing gravel travels to the far end.

Figure 3:
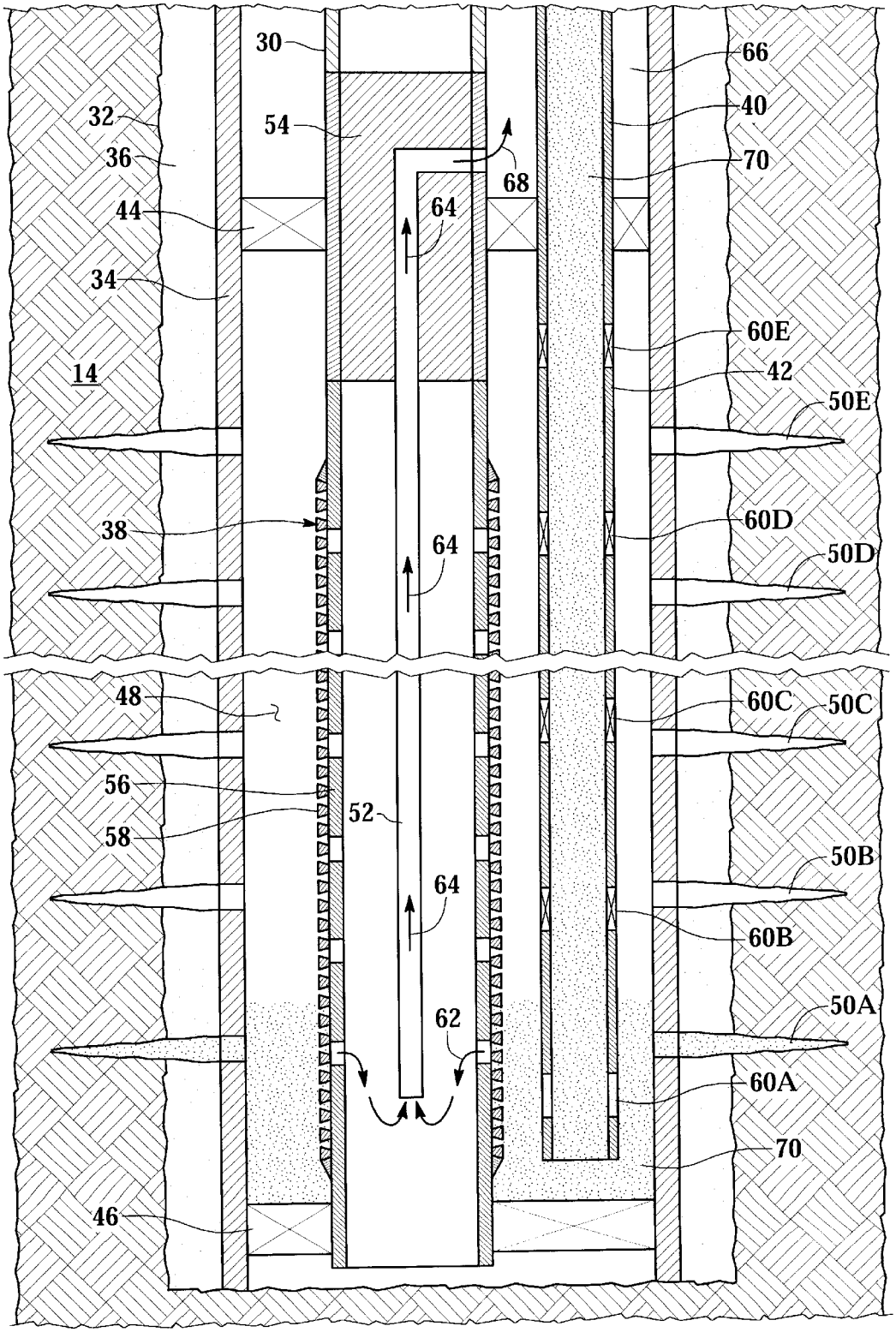
FIG. 3 is a half sectional view of an apparatus for progressively treating an interval of a wellbore of the present invention after the first progression of the apparatus.

Once the pressure in fluid delivery tubular 40 increases to a sufficient level, the progressive operation of the present invention may begin. Specifically, as best seen in FIG. 3, actuatable member 60A is actuated which allows the fluid slurry containing gravel 70 to travel from fluid delivery tubular 40 through actuatable member 60A into interval 48. As the fluid slurry containing gravel 70 enters interval 48, the gravel 70 drops out of the slurry and builds up from formation 14, filling perforation 50A and interval 48 around the far section of screen assembly 38 forming the initial portion of the gravel pack. Some of the carrier fluid in the slurry may leak off through perforation 50A into formation 14 while the remainder of the carrier fluid passes through screen assembly 38, as indicated by arrows 62, that is sized to prevent gravel 70 from flowing therethrough. The fluid flowing back through screen assembly 38, as explained above, follows the paths indicated by arrows 64, 68 back to the surface.

Figure 4:
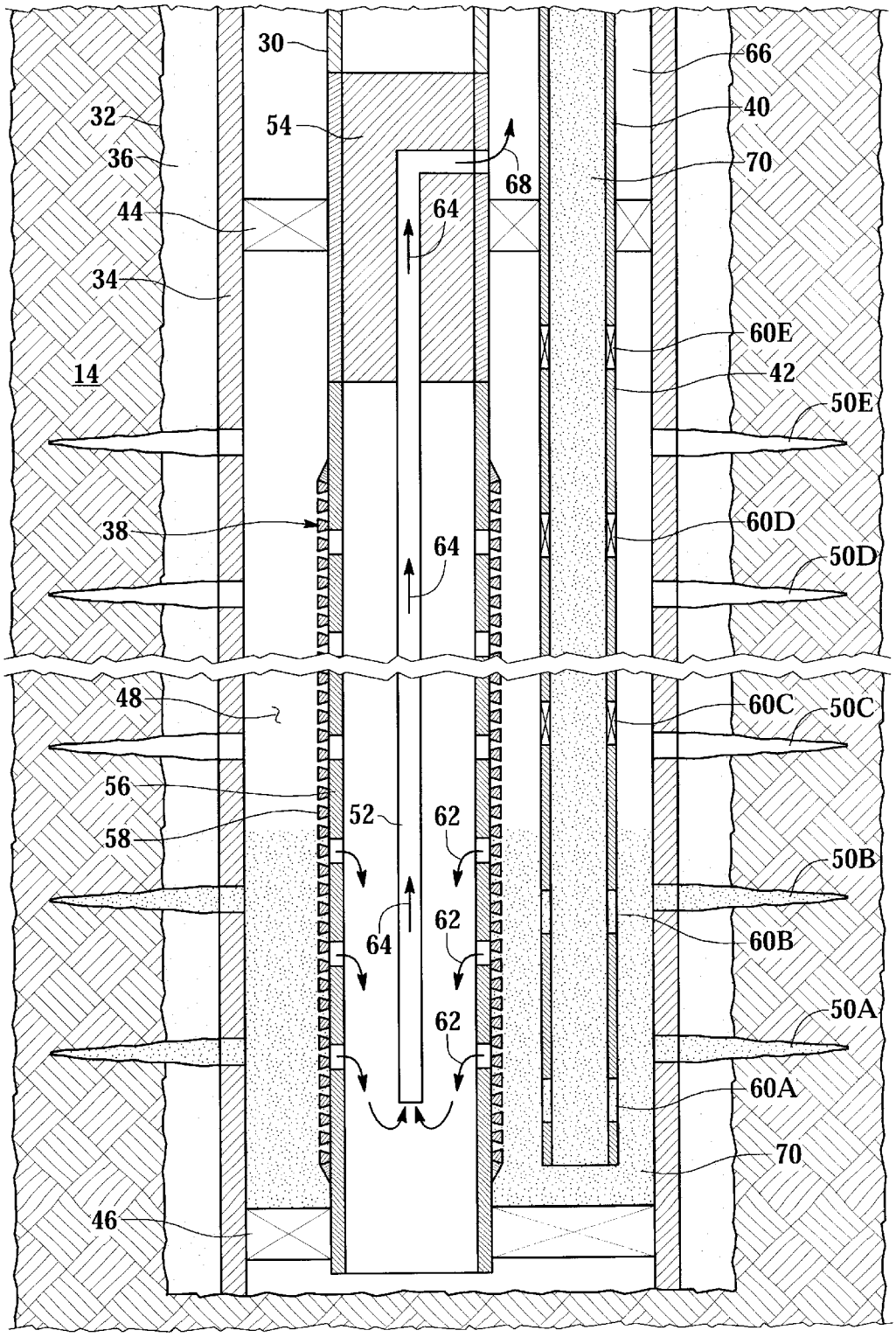
FIG. 4 is a half sectional view of an apparatus for progressively treating an interval of a wellbore of the present invention after the second progression of the apparatus.

As the initial portion of the gravel pack becomes tightly packed, the pressure in fluid deliver tubular 40 again increases. At this point and as best seen in FIG. 4, actuatable member 60B is actuated which allows the fluid slurry containing gravel 70 to travel from fluid deliver tubular 40 through actuatable member 60B. As the fluid slurry containing gravel 70 enters interval 48, the gravel 70 drops out of the slurry and builds up from formation 14, filling perforation 50B and interval 48 around the adjacent section of screen assembly 38 forming the next portion of the gravel pack. While some of the carrier fluid in the slurry may leak off through perforation 50B into formation 14, the remainder of the carrier fluid passes through screen assembly 38, as indicated by arrows 62 and returns to the surface as indicated by arrows 64, 68.

Figure 5:
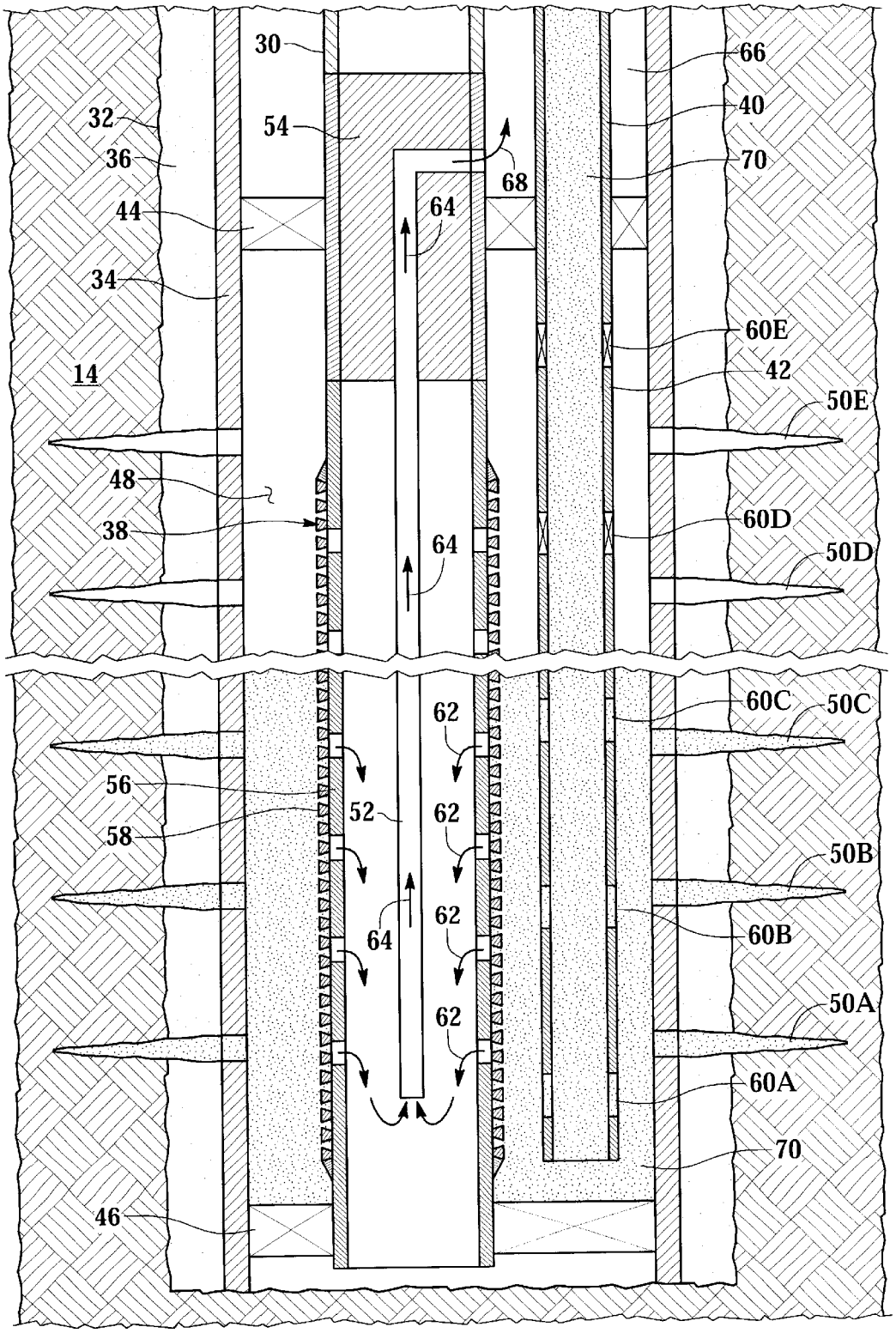
FIG. 5 is a half sectional view of an apparatus for progressively treating an interval of a wellbore of the present invention after the third progression of the apparatus.

As this portion of the gravel pack becomes tightly packed, the pressure in fluid delivery tubular 40 again increases. At this point and as best seen in FIG. 5, actuatable member 60C is actuated which allows the fluid slurry containing gravel 70 to travel from fluid delivery tubular 40 through actuatable member 60C. As the fluid slurry containing gravel 70 enters interval 48, the gravel 70 drops out of the slurry and builds up from formation 14, filling perforation 50C and interval 48 around the adjacent section of screen assembly 38 forming the next portion of the gravel pack. While some of the carrier fluid in the slurry may leak off through perforation 50C into formation 14, the remainder of the carrier fluid passes through screen assembly 38, as indicated by arrows 62 and returns to the surface as indicated by arrows 64, 68.

Figure 6:
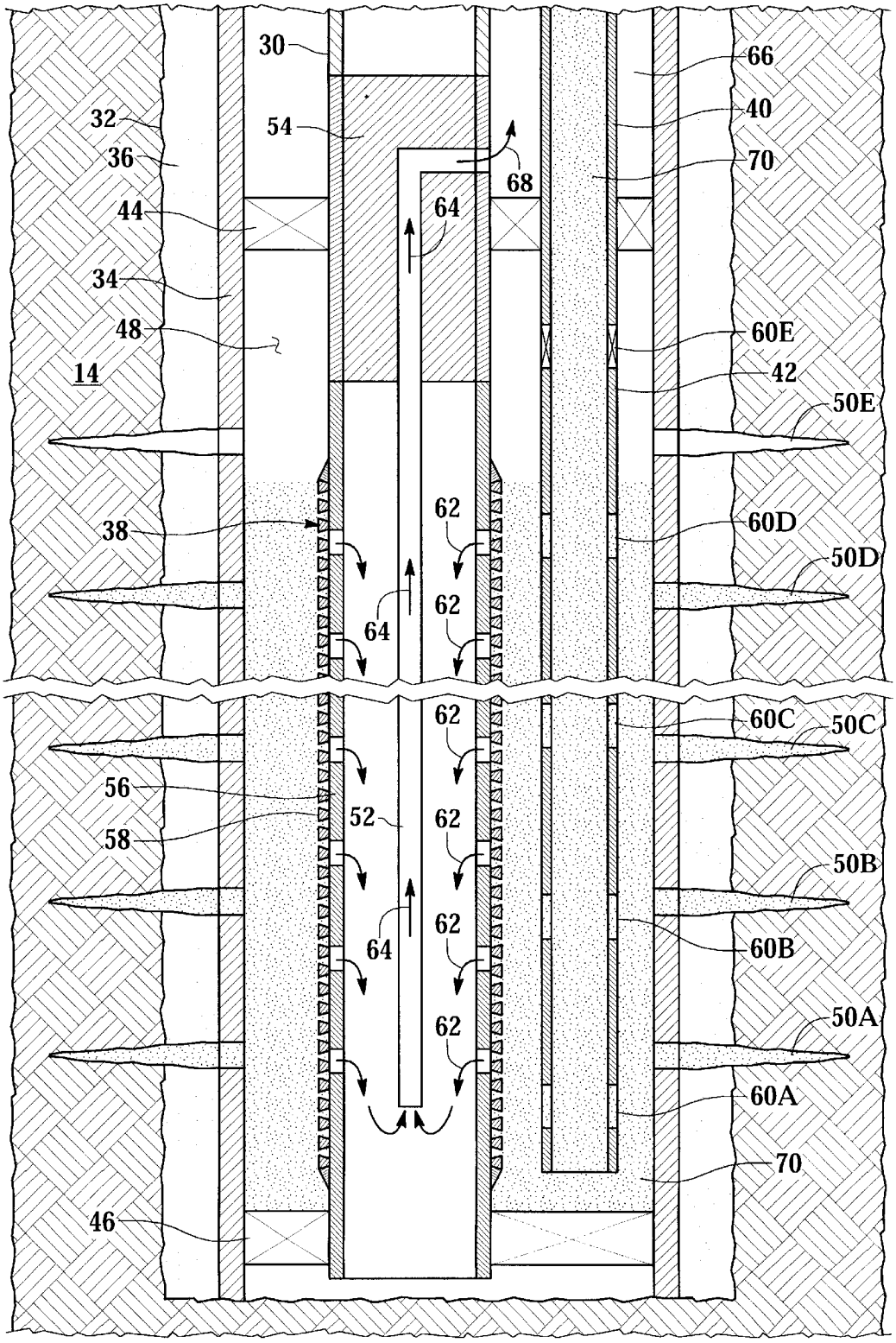
FIG. 6 is a half sectional view of an apparatus for progressively treating an interval of a wellbore of the present invention after the next to last progression of the apparatus.

This process continues to progress from the far end of interval 48 toward the near end of interval 48. Specifically, as best seen in FIG. 6, actuatable member 60D is actuated which allows the fluid slurry containing gravel 70 to travel from fluid delivery tubular 40 through actuatable member 60D. As the fluid slurry containing gravel 70 enters interval 48, the gravel 70 drops out of the slurry and builds up from formation 14, filling perforation 50D and interval 48 around the adjacent section of screen assembly 38 forming the next portion of the gravel pack. While some of the carrier fluid in the slurry may leak off through perforation 50D into formation 14, the remainder of the carrier fluid passes through screen assembly 38, as indicated by arrows 62 and returns to the surface as indicated by arrows 64, 68.

Figure 7:
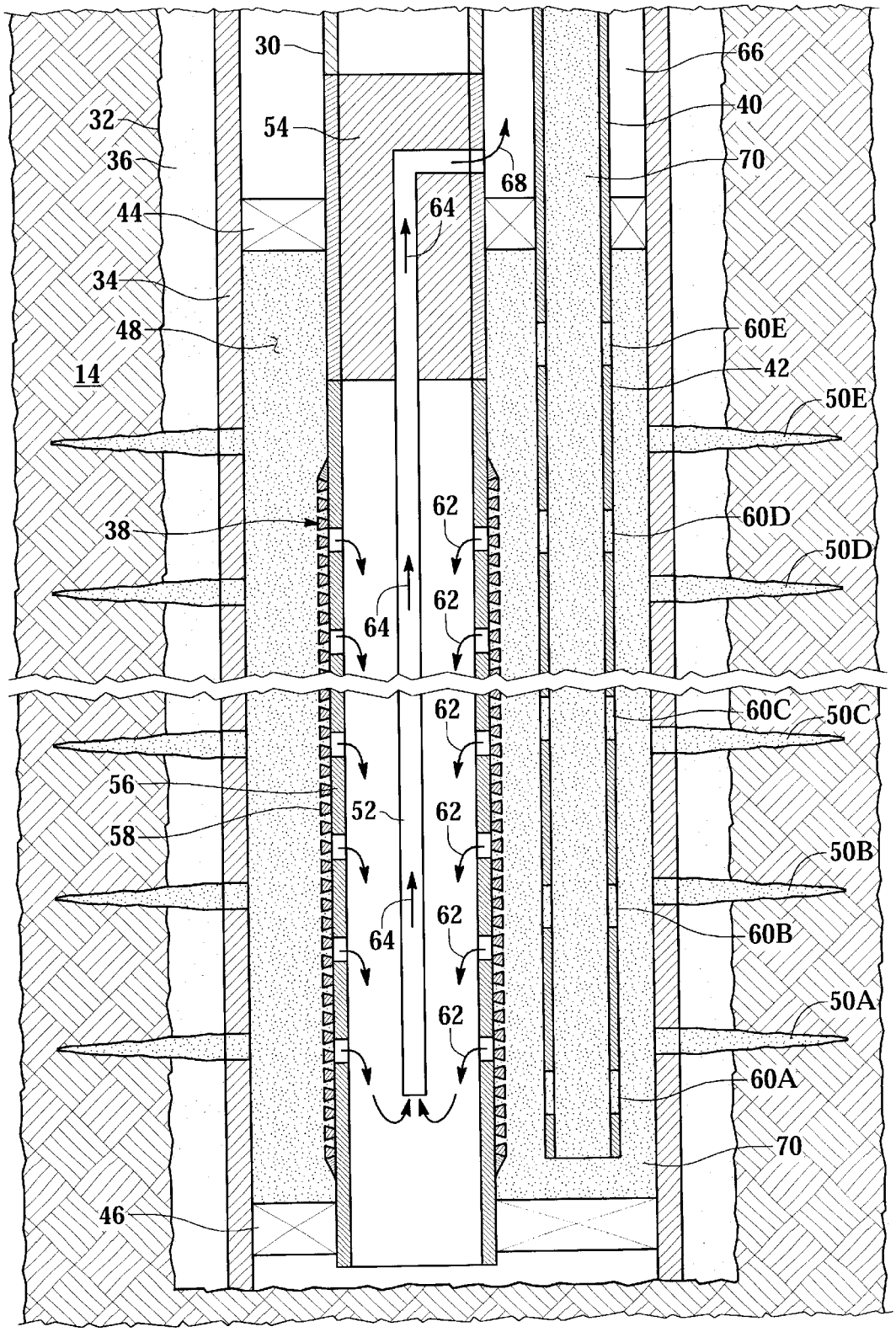
FIG. 7 is a half sectional view of an apparatus for progressively treating an interval of a wellbore of the present invention after the last progression of the apparatus.

As this portion of the gravel pack becomes tightly packed, the pressure in fluid delivery tubular 40 again increases. At this point and as best seen in FIG. 7, the last actuatable member, actuatable member 60E, is actuated which allows the fluid slurry containing gravel 70 to travel from fluid delivery tubular 40 through actuatable member 60E. As the fluid slurry containing gravel 70 enters interval 48, the gravel 70 drops out of the slurry and builds up from formation 14, filling perforation 50E and interval 48 around the adjacent section of screen assembly 38 to packer 44 forming the last portion of the gravel pack. While some of the carrier fluid in the slurry may leak off through perforation 50E into formation 14, the remainder of the carrier fluid passes through screen assembly 38, as indicated by arrows 62 and returns to the surface as indicated by arrows 64, 68.

As can be seen, using the present invention for progressively treating an interval of a wellbore, a gravel pack may progress from one end of an interval toward the other end of an interval as fluid communication is progressively established along the entire length of the interval. Also, as should be apparent to those skilled in the art, even though FIGS. 2–7 present the progressive gravel packing of an interval of a wellbore in a vertical orientation with packer 44 at the top of interval 48 and packer 46 at the bottom of interval 48, these figures are intended to also represent wellbores that have alternate directional orientations such as inclined wellbores and horizontal wellbores. In the horizontal orientation, for example, packer 44 is at the heel of interval 48 and packer 46 is at the toe of interval 48.

Likewise, even though FIGS. 2–7 present the progressive gravel packing of an interval of a wellbore as being progressively performed from the far end of the interval to the near end of the interval, those skilled in the art will understand that the progressive gravel packing process of the present invention can alternatively be performed from the near end of the interval to the far end of the interval.

As stated above, there are numerous ways to progressively actuate actuatable members 60A–60E. In the preferred method described above, the pressure created by the fluid slurry within fluid delivery tubular 40 progressively triggers the actuation of actuatable members 60A–60E. One way to implement this method is to position actuatable members 60A–60E within fluid delivery tubular 40 such that the pressure required to actuate actuatable members 60A–60E progressively increases from the one end of interval 48 to the other end of interval 48. For example, each adjacent actuatable member may be set to actuate at an incremental pressure above the prior actuatable members such as at increments of between about 50–100 psi. This assures a proper progression of the gravel pack by preventing any out of sequence activations. In addition, this approach is particularly advantageous in that the incremental pressure increase of adjacent actuatable members helps to insure that each section of the gravel pack is tightly packed prior to initiating the gravel packing of subsequent sections.

Alternatively, a hard wired or wireless telemetry system may be used to progressively actuate actuatable members 60A–60E. For example, each actuatable member may be actuated by sending a signal addressed to a specific actuatable member. This assures a proper progression of the gravel pack by preventing any out of sequence activations. The signals may be manually or automatically sent based upon time or the pressure response in fluid delivery tubular 40. For example, the signal to actuate the next actuatable member may be sent each time the pressure within fluid delivery tubular 40 reaches a particular level or each time the pressure within fluid delivery tubular 40 reaches the next preselected pressure increment. As with the direct pressure response method, the particular actuation sequence should insure that each section of the gravel pack is tightly packed prior to initiating the gravel packing of subsequent sections.

Figure 8:
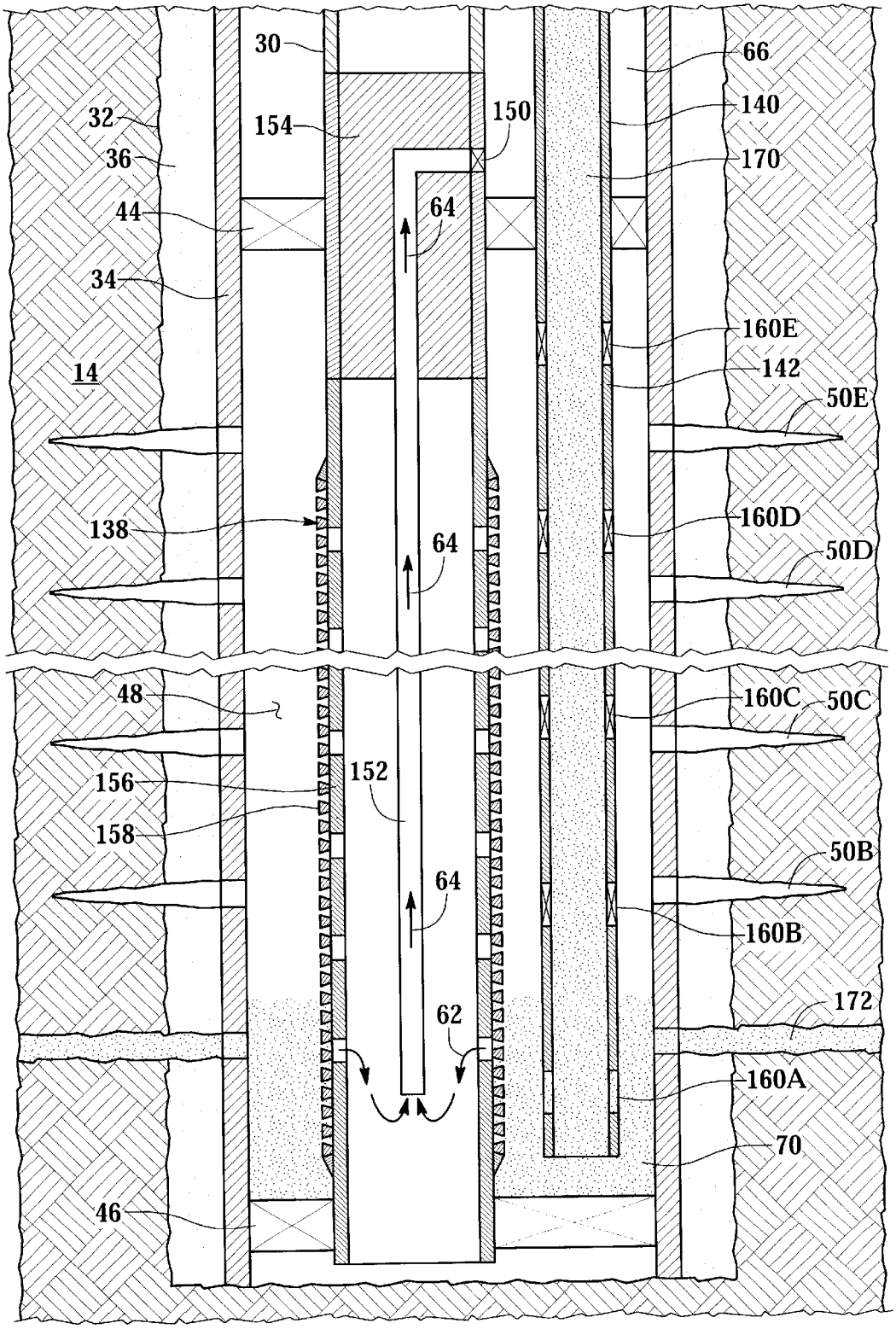
FIG. 8 is a half sectional view of another embodiment of an apparatus for progressively treating an interval of a wellbore of the present invention after the first progression of the apparatus.

Referring now to FIG. 8, therein is depicted another embodiment of the present invention that is used for frac packing interval 48. As illustrated, screen assembly 138 is eccentrically positioned within casing 34 and is adjacent to formation 14. A wash pipe 152 is positioned within screen assembly 138. Wash pipe 152 extends into a cross-over assembly 154 which is connected to work string 30 extending from the surface. Cross-over assembly 154 includes a valve 150 that is used to selectively allow and prevent the flow of return fluid to the surface via wash pipe 152. Alternatively, a surface valve (not pictured) may be used to prevent the flow of return fluid. As illustrated, screen assembly 138 includes a perforated base pipe 156 having a wire 158 wrapped directly thereon, however, other types of filter media may alternatively be used.

In the illustrated embodiment, fluid discharge section 142 of fluid delivery tubular 140 includes a plurality of progressively actuatable members 160A–160E which are preferable valves, such as pressure actuated one-way valves that selectively allow fluid to flow from the interior of fluid delivery tubular 140 to the exterior of fluid delivery tubular 140. Actuatable members 160A–160E may alternatively be progressively actuated using a variety of known techniques such as sending a signal via a hard wire connection, fiber optics, hydraulics, wireless telemetry including pressure pulses, electromagnetic waves or acoustic signals and the like.

To begin the completion process, interval 48 adjacent to formation 14 is isolated. Packer 44 seals the near end of interval 48 and packer 46 seals the far end of interval 48. Cross-over assembly 154 is located adjacent to screen assembly 138, traversing packer 44 with portions of cross-over assembly 154 on either side of packer 44. As illustrated, when the treatment operation is a frac pack, the objective is to enhance the permeability of formation 14 by delivering a fluid slurry containing proppants 170 at a high flow rate and in a large volume above the fracture gradient of formation 14 such that fractures may be formed within formation 14 and held open by the proppants 170. In addition, a frac pack also has the objective of preventing the production of fines by packing interval 48 with the proppants 170. To help achieve these results, valve 150 of cross-over assembly 154 is initially in the closed position to prevent returns from flowing therethrough.

The fluid slurry containing proppants 170 is pumped down-fluid delivery tubular 140. In the illustrated embodiment, the fluid slurry containing proppants 170 travels to the far end of interval 48 through fluid delivery tubular 140. At this point, the fluid slurry containing proppants 170 may exit the far end of fluid delivery tubular 140 if it is open or builds up in fluid delivery tubular 140 if it is closed at the far end. In either case, the pressure within fluid delivery tubular 140 will begin to increase.

Once the pressure in fluid delivery tubular 140 increases to a sufficient level, the progressive operation of the present invention may begin. Specifically, as best seen in FIG. 8, actuatable member 160A is actuated which allows the fluid slurry containing proppants 170 to travel from fluid delivery tubular 140 through actuatable member 160A into interval 48. As the fluid slurry containing proppants 170 is being delivered at a high flowrate and in a large volume above the fracture gradient of formation 14 and as valve 150 is closed, the fluid slurry fractures formation 14 as indicated by fracture 172. As this portion of interval 48 begins to screen out, the pressure within fluid delivery tubular 140 will rise causing the progressive actuation of actuatable members 160B–160E in the manner described above with reference to FIGS. 3–7. It should be noted that as the frac pack operation progresses some of the proppants 170 in the fluid slurry will remain in interval 48, thereby packing interval 48 around screen assembly 138. This packing process may be enhanced by reducing the flow rate of the fluid slurry toward the end of the treatment process and opening valve 150 to allow some returns to flow to the surface as described above.

Figure 9:
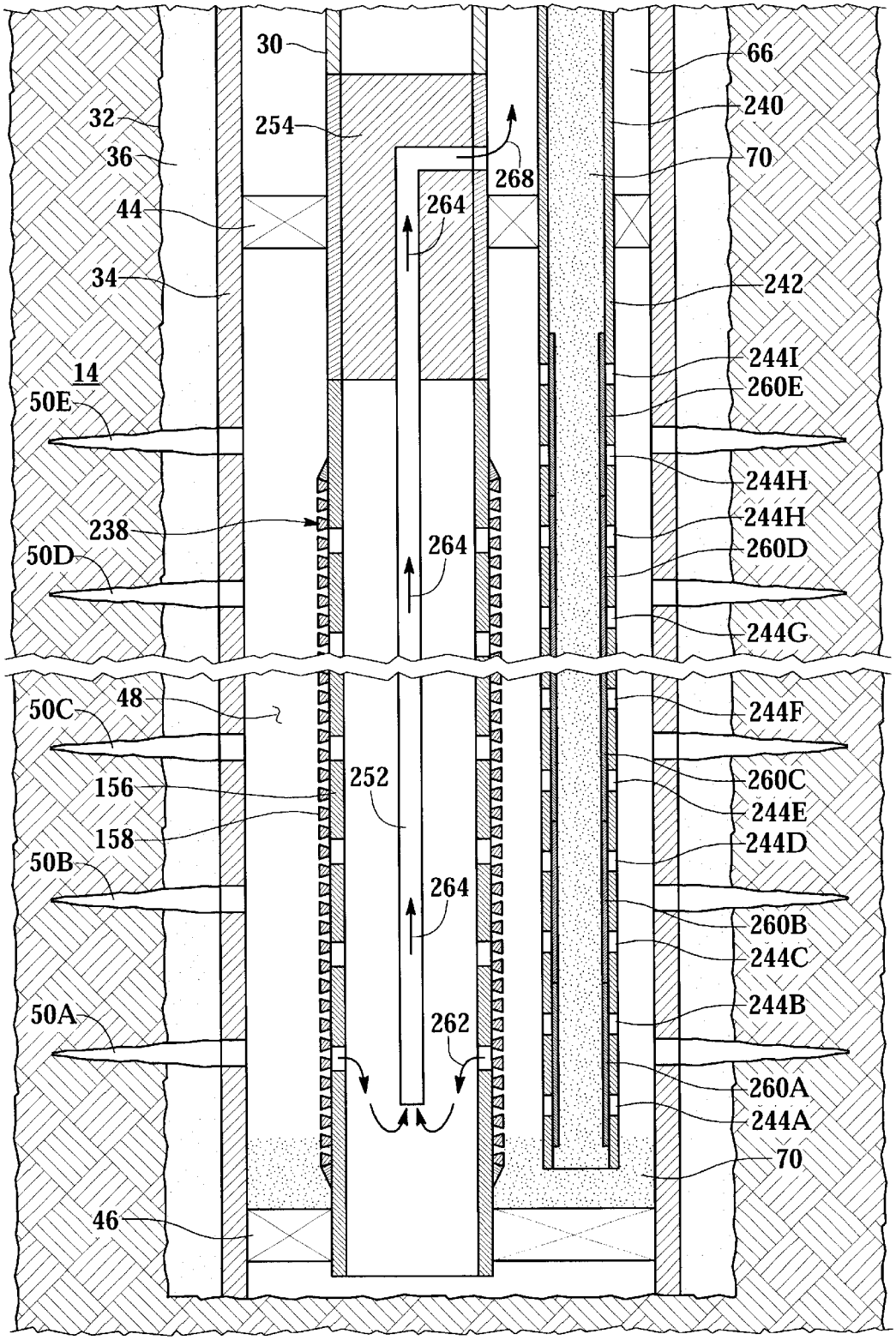
FIG. 9 is a half sectional view of another embodiment of an apparatus for progressively treating an interval of a wellbore of the present invention in its initial position.

Referring now to FIG. 9, therein is depicted another embodiment of an apparatus for progressively treating an interval of a wellbore. As illustrated, screen assembly 238 is eccentrically positioned within casing 34 and is adjacent to formation 14. A wash pipe 252 is positioned within screen assembly 238. Wash pipe 252 extends into a cross-over assembly 254 which is connected to work string 30 extending from the surface. Screen assembly 238 is designed to allow fluid to flow therethrough but prevent particulate matter of sufficient size from flowing therethrough. The exact design of screen assembly 238 is not critical to the present invention as long as it is suitably designed for the characteristics of the formation fluids and the treatment fluids. For example, as illustrated, screen assembly 238 includes a perforated base pipe 256 having a wire 258 wrapped directly thereon. Other types of screen assemblies having other types of filter media may alternatively be used.

In the illustrated embodiment, fluid discharge section 242 of fluid delivery tubular 240 includes a plurality of perforations 244A–244J that are selective blocked by removable members 260A–260E. Removable members 260A–260E may be constructed from a variety of materials such as combustible materials, referred to herein as propellants, that are removable by combustion, friable materials, including ceramics, that are removable by disintegration, or other materials that are removable in a downhole environment.

When removable members 260A–260E are constructed from propellants, suitable initiators are attached to each removable member 260A–260E such that the combustion process of each removable member 260A–260E may be triggered independently. The initiators may be operated using a variety of known techniques including pressure actuation, electrical actuation, acoustic actuation or the like. For example, as explained in more detail below, the pressure generated by the treatment fluid can be used to trigger the initiators. Alternatively, a signal may be sent to trigger each of the removeable members 260A–260E via a hard wired connection, fiber optics, hydraulics, a wireless telemetry system utilizing pressure pulses, electromagnetic waves or acoustic signals and the like.

When removable members 260A–260E are constructed from friable materials, suitable vibration generators are attached to each removable member 260A–260E such that the disintegration process of each removable member 260A–260E may be triggered independently. The vibration generators may be operated using a variety of known techniques such as those described above.

To begin the completion process, interval 48 adjacent to formation 14 is isolated. Packer 44 seals the near end of interval 48 and packer 46 seals the far end of interval 48. Cross-over assembly 254 is located adjacent to screen assembly 238, traversing packer 44 with portions of cross-over assembly 254 on either side of packer 44. As illustrated, when the treatment operation is a gravel pack, the objective is to uniformly and completely fill interval 48 with gravel. To help achieve this result, wash pipe 252 is disposed within screen assembly 238. Wash pipe 252 extends into cross-over assembly 254 such that return fluid passing through screen assembly 238, indicated by arrows 262, may travel through wash pipe 252, as indicated by arrow 264, and into annulus 66, as indicted by arrow 268, for return to the surface.

The fluid slurry containing gravel 70 is pumped down fluid delivery tubular 240. In the illustrated embodiment, the fluid slurry containing gravel 70 travels to the far end of interval 48 through fluid delivery tubular 240. At this point, a portion of fluid slurry containing gravel 70 exits the open end of the fluid delivery tubular 240 if this end is open to flow.

As the pressure in fluid delivery tubular 240 increases to a sufficient level, the progressive operation of the present invention may begin. Specifically, removable member 260A is removed which allows the fluid slurry containing gravel 70 to travel from fluid delivery tubular 40 through perforations 244A–244B into interval 48. As the fluid slurry containing gravel 70 enters interval 48, the gravel 70 drops out of the slurry and builds up from formation 14, filling perforation 50A and interval 48 around the end section of screen assembly 238 forming the initial portion of the gravel pack. Some of the carrier fluid in the slurry may leak off through perforation 50A into formation 14 while the remainder of the carrier fluid passes through screen assembly 238, as indicated by arrows 262, that is sized to prevent gravel 70 from flowing therethrough. The fluid flowing back through screen assembly 238, as explained above, follows the paths indicated by arrows 264, 268 back to the surface.

As the pressure within fluid delivery tubular 140 increases, removable member 260B is removed which allows fluid flow through perforations 244C–244D into interval 48 which packs perforation 50B and the section of screen assembly 238 adjacent thereto. This process progresses from the far end of interval 48 to the near end of interval 48 by progressively removing removable member 260C, which exposes perforations 244E–244F, removable member 260D, which exposes perforations 244G–244H, and removable member 260E, which exposes perforations 244I–244J. Accordingly, the entire interval 48 is progressively gravel packed. After the treatment process is completed, a valve (not pictured) in fluid delivery tubular 240 may be closed to prevent the flow of fluids, for example production fluids, to the surface therethrough.

As stated above, there are numerous ways to remove removable members 260 from fluid discharge section 242 of fluid delivery tubular 240 to progressively establish fluid communication between the interior of fluid delivery tubular 240 and the exterior of fluid delivery tubular 240. One preferred method allows the pressure created by the treatment fluid within fluid delivery tubular 240 to progressively trigger the removal of removable members 260. For example, when the removable members 260 are constructed of propellant material, pressure activated firing devices may be attached to initiators that are coupled on each of the removable members 260. The pressure activated firing devices are then positioned within fluid delivery tubular 240 such that the pressure required to fire the pressure activated firing devices progressively increases from, for example, the far end of interval 48 toward the near end of interval 48. Each adjacent pressure activated firing device may be set to fire at an incremental pressure above the prior pressure activated firing device such as at increments of between about 50–100 psi. This assures a proper progression of the gravel pack by preventing any out of sequence activations. In addition, this approach is particularly advantageous in that the incremental pressure increase of adjacent pressure activated firing devices helps to insure that each section of the gravel pack is tightly packed prior to initiating the gravel packing of subsequent sections.

Alternatively, a signal may be used to progressively trigger the removal of removable member 260. For example, when the removable members 260 are constructed of a friable material, vibration generators may be coupled on each of the removable members 260. Each vibration generator may be activated by a particular signal addressed specifically for that vibration generator. This assures a proper progression of the gravel pack by preventing any out of sequence activations. The signals may be manually or automatically sent based upon time or the pressure response in fluid delivery tubular 240. For example, the signal to remove the next removable member 260 may be sent each time the pressure within fluid delivery tubular 240 reaches a particular level or each time the pressure within fluid delivery tubular 240 reaches the next preselected pressure increment. As with the direct pressure response method, the particular removal sequence should insure that each section of the gravel pack is tightly packed prior to initiating the gravel packing of subsequent sections.

Even though FIG. 9 has depicted removable members 260A–260E as being positioned on the interior of fluid delivery tubular 240, it should be understood by those skilled in the art that removable members could alternatively be positioned on the exterior of fluid delivery tubular 240 without departing from the principles of the present invention. Also, even though the embodiment of the apparatus for progressively treating an interval of a wellbore described in FIG. 9 referred to permanently removing the removable members, other types of removable members that are temporarily removed may alternatively be used, including, but not limited to, sliding sleeves and the like, without departing from the principles of the present invention.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An apparatus for progressively treating an interval of a wellbore comprising:

a sand control screen eccentrically positioned within the wellbore; and a fluid delivery tubular disposed within the wellbore adjacent to the sand control screen, the fluid delivery tubular having a plurality of openings distributed along at least a portion of the length of the fluid delivery tubular, the fluid delivery tubular progressively allowing fluid communication from an interior of the fluid delivery tubular to an exterior of the fluid delivery tubular through the openings from a first end of the interval to a second end of the interval.

2. The apparatus as recited in claim 1 wherein the fluid delivery tubular further comprises a plurality of actuatable members operably associated with the openings.

3. The apparatus as recited in claim 2 wherein the actuatable members are rupture disks that are positioned along the fluid delivery tubular such that the pressure required to actuate the rupture disks progressively increases from the first end to the second end of the interval.

4. The apparatus as recited in claim 2 wherein the actuatable members are pressure actuated one-way valves that are positioned along the fluid delivery tubular such that the pressure required to actuate the one-way valves progressively increases from the first end to the second end of the interval.

5. The apparatus as recited in claim 2 wherein the actuatable members are valves that are progressively actuated from the first end to the second end of the interval in response to signals.

6. The apparatus as recited in claim 1 wherein the fluid delivery tubular further comprises a plurality of propellant members that are progressively combustible from the first end of the interval to the second end of the interval.

7. The apparatus as recited in claim 6 wherein each of the propellant members further comprises an initiator.

8. The apparatus as recited in claim 7 wherein the initiators further comprise initiators that are activated by signals.

9. The apparatus as recited in claim 7 wherein the initiators further comprise pressure activated firing devices.

10. The apparatus as recited in claim 9 wherein the pressure activated firing devices are positioned such that the pressure required to tire the pressure activated firing devices progressively increases from the first end to the second end of the interval.

11. The apparatus as recited in claim 1 wherein the fluid delivery tubular further comprises a plurality of friable members that are progressively removable from the first end of the interval to the second end of the interval.

12. The apparatus as recited in claim 11 wherein each of the friable members further comprises a pressure actuated vibration generator and wherein the pressure actuated vibration generators are positioned such that the pressure required to activate the pressure actuated vibration generators progressively increases from the first end to the second end of the interval.

13. The apparatus as recited in claim 11 wherein each of the friable members further comprises a vibration generator and wherein the vibration generators are progressively activated from the first end to the second end of the interal by signals.

14. The apparatus as recited in claim 1 wherein the first end is closer to a far end of the wellbore than the second end.

15. The apparatus as recited in claim 1 wherein the first end is closer to a near end of the wellbore than the second end.

16. An apparatus for progressively treating an interval of a wellbore comprising:

a sand control screen eccentrically positioned within the wellbore; and a fluid delivery tubular disposed within the wellbore adjacent to the sand control screen, the fluid delivery tubular progressively allowing fluid communication from an interior of the fluid delivery tubular to an exterior of the fluid delivery tubular from a first end of the interval to a second end of the interval through a plurality of pressure actuated actuatable members operably associated with a plurality of openings distributed along at least a portion of the length to the fluid delivery tubular as the pressure created by a treatment fluid pumped into the interior of the fluid delivery tubular progressively increases from the first end of the interval to the second end of the interval.

17. The apparatus as recited in claim 16 wherein the actuatable members are pressure actuated one-way valves that are positioned along the fluid delivery tubular such that the pressure required to actuate the one-way valves progressively increases from the first end to the second end of the interval.

18. The apparatus as recited in claim 16 wherein the first end is closer to a far end of the wellbore than the second end.

19. The apparatus as recited in claim 16 wherein the first end is closer to a neat end of the wellbore than the second end.

20. An apparatus for progressively treating an interval of a wellbore comprising:

a sand control screen eccentrically positioned within the wellbore; and a fluid delivery tubular disposed within the wellbore adjacent to the sand control screen, the fluid delivery tubular including a perforated pipe and a plurality of propellant members disposed thereon, each propellant member having a pressure activated firing device associated therewith, the pressure activated firing devices are positioned such that the pressure required to fire the pressure activated firing devices progressively increases from a first end of the interval to a second end of the interval, thereby progressively allowing fluid communication from an interior of the fluid delivery tubular to an exterior of the fluid delivery tubular as the pressure created by a treatment fluid pumped into the interior of the fluid delivery tubular progressively increases from the first end of the interval to the second end of the interval.

21. The apparatus as recited in claim 20 wherein the first end is closer to the far end of the wellbore than the second end.

22. The apparatus as recited in claim 20 wherein the first end is closer to the near end of the wellbore than the second end.

23. A method for progressively treating an interval of a wellbore, the method comprising the steps of:

traversing a formation with the wellbore;

locating a sand control screen eccentrically within the wellbore proximate the formation;

positioning a fluid delivery tubular within the wellbore adjacent to the sand control screen, the fluid delivery tubular having a plurality of openings distributed along at least portion of the length of the fluid delivery tubular;

injecting a treatment fluid into the fluid delivery tubular;

progressively establishing fluid communication between an interior of the fluid delivery tubular and an exterior of the fluid delivery tabular through the openings from a first end to a second end of the interval; and terminating the injecting.

24. The method as recited in claim 23 wherein the step of positioning a fluid delivery tubular within the wellbore adjacent to the sand control screen further comprises operably associating a plurality of actuatable members with the openings.

25. The method as recited in claim 24 wherein the step of distributing a plurality of actuatable members along a portion of the length of the fluid delivery tubular further comprises distributing a plurality of rupture disks along the portion of the length of the fluid delivery tubular.

26. The method as recited in claim 24 wherein the step of distributing a plurality of actuatable members along a portion of the length of the fluid delivery tubular further comprises distributing a plurality of one-way valves along the portion of the length of the fluid delivery tubular.

27. The method as recited in claim 26 further comprising progressively actuating the one-way valves from the first end to the second end in response to pressure within the fluid delivery tubular.

28. The method as recited in claim 26 further comprising progressively actuating the one-way valves from the first end to the second end in response to signals.

29. The method as recited in claim 23 wherein the step of progressively establishing fluid communication between an interior of the fluid delivery tubular and an exterior of the fluid delivery tubular through the openings from a first end to a second end of the interval further comprises progressively removing a plurality of removable members from the first end to the second end of the interval.

30. The method as recited in claim 29 wherein the step of progressively removing a plurality of removable members further comprises progressively combusting a plurality of propellant members from the first end to the second end of the interval.

31. The method as recited in claim 30 wherein the step of progressively combusting the propellant members from the first end to the second end further comprises initiating the combustion with a signal.

32. The method as recited in claim 30 wherein the step of progressively combusting the propellant members from the first end to the second end further comprises initiating the combustion with pressure activated firing devices.

33. The method as recited in claim 32 wherein the step of initiating the combustion with pressure activated firing devices further comprises positioning the pressure activated firing devices such that the pressure required to fire the pressure activated firing devices progressively increases from the first end to the second end.

34. The method as recited in claim 29 wherein the step off progressively removing a plurality of removable members further comprises progressively removing a plurality of friable members from the first end to the second end.

35. The method as recited in claim 34 further comprising the step of progressively removing the friable members from the first end to the second end by progressively actuating pressure actuated vibration generators coupled to the friable members that are positioned such that the pressure required to actuate the pressure actuated vibration generators progressively increases from the first end to the second end.

36. The method as recited in claim 34 further comprising the step of progressively removing the friable members from the first end to the second end by progressively actuating vibration generators coupled to the friable members with signals.

37. The method as recited in claim 23 wherein the step of progressively establishing fluid communication between an interior of the fluid delivery tubular and an exterior of the fluid delivery tubular through the openings from a first end to a second end of the interval further comprises positioning the first end closer to the far end of the wellbore than the second end.

38. The method as recited in claim 23 wherein the step of progressively establishing fluid communication between an interior of the fluid delivery tubular and an exterior of the fluid delivery tubular through the openings from a first end to a second end of the interval further comprises positioning the first end closer to the near end of the wellbore than the second end.

39. A method for progressively treating an interval of a wellbore, the method comprising the steps of:

traversing a formation with the wellbore;

locating a sand control screen eccentrically within the wellbore proximate the formation;

positioning a fluid delivery tubular having a plurality of actuatable members operably associated with a plurality of openings distributed along at least a portion of the length of the fluid delivery tubular within the wellbore adjacent to the sand control screen;

injecting a treatment fluid into the fluid delivery tubular;

progressively actuating the actuatable members to establish fluid communication between an interior of the fluid delivery tubular and an exterior of the fluid delivery tubular from a first end to a second end of the interval; and terminating the injecting.

40. The method as recited in claim 39 wherein the step of progressively actuating the actuatable members to establish fluid communication between an interior of the fluid delivery tubular and an exterior of the fluid delivery tubular from a first end to a second end of the interval further Comprises progressively actuating a plurality of rupture disks from the first end to the second end of the interval.

41. The method as recited in claim 39 wherein the step of progressively actuating the actuatable members to establish fluid communication between an interior of the fluid delivery tubular and an exterior of the fluid delivery tubular from a first end to a second end of the interval further comprises progressively actuating a plurality of one-way valves from the first end to the second end of the interval.

42. The method as recited in claim 41 further comprising progressively actuating the one-way valves from the first end to the second end in response to pressure within the fluid delivery tubular.

43. The method as recited in claim 41 further comprising progressively actuating the one-way valves from the first end to the second end in response to signals.

44. The method as recited in claim 39 wherein the step of progressively actuating the actuatable members to establish fluid communication between an interior of the fluid delivery tubular and an exterior of the fluid delivery tubular from a first; end to a second end of the interval further comprises positioning the first end closer to the far end of the wellbore than the second end.

45. The method as recited in claim 39 wherein the step of progressively actuating the actuatable members to establish fluid communication between an interior of the fluid delivery tubular and an exterior of the fluid delivery tubular from a first end to a second end of the interval further comprises positioning the first end closer to the near end of the wellbore than the second end.

46. A method for progressively treating an interval of a wellbore, the method comprising the steps of:

traversing a formation with the wellbore;

locating a sand control screen eccentrically within the wellbore proximate the formation;

positioning a fluid delivery tubular having a plurality of propellant members distributed along a portion of the length of the fluid delivery tubular within the wellbore adjacent to the sand control screen;

injecting a treatment fluid into the fluid delivery tubular; progressively actuating pressure activated firing devices coupled to each propellant member, the pressure activated firing devices being positioned such that the pressure required to fire the pressure activated firing devices progressively increases from the first end to the second end of the interval to progressively establish fluid communication between an interior of the fluid delivery tubular and an exterior of the fluid delivery tubular from a first end to a second end of the interval; and terminating the injecting.

47. The method as recited in claim 46 wherein the step progressively actuating the pressure activated firing devices from the first end to the second end of the interval further comprises positioning the first end closer to the far end of the wellbore than the second end.

48. The method as recited in claim 46 wherein the step progressively actuating the pressure activated firing devices from the first end to the second end of the interval further comprises positioning the first end closer to the near end of the wellbore than the second end.

49. An apparatus for progressively treating an interval of a wellbore comprising:

a sand control screen eccentrically positioned within the wellbore; and a fluid delivery tubular disposed within the wellbore adjacent to the sand control screen, the fluid delivery tubular including a plurality of propellant members that are progressively combustible from a first end of the interval to a second end of the interval, thereby progressively allowing fluid communication from an interior of the fluid delivery tubular to an exterior of the fluid delivery tubular from the first end of the interval to the second end of the interval.

50. The apparatus as recited in claim 49 wherein each of the propellant members further comprises an initiator.

51. The apparatus as recited in claim 50 wherein the initiators further comprise initiators that are activated by signals.

52. The apparatus as recited in claim 50 wherein the initiators further comprise pressure activated firing devices.

53. The apparatus as recited in claim 52 wherein the pressure activated firing devices are positioned such that the pressure required to fire the pressure activated firing devices progressively increases from the first end to the second end of the interval.

54. The apparatus as recited in claim 49 wherein the first end is closer to a far end of the wellbore than the second end.

55. The apparatus as recited in claim 49 wherein the first end is closer to a near end of the wellbore than the second end.

* * * * *